United States Patent [19]

Kränzle

[11] Patent Number: 4,747,544

[45] Date of Patent: May 31, 1988

[54] SPRAY DEVICE

[76] Inventor: Josef Kränzle, Rudolf-Diesel-Str. 20, D-7918 Illertissen, Fed. Rep. of Germany

[21] Appl. No.: 904,703

[22] Filed: Sep. 8, 1986

[30] Foreign Application Priority Data

Sep. 9, 1985 [DE] Fed. Rep. of Germany ..... 3532045

[51] Int. Cl.[4] ..... B05B 3/06

[52] U.S. Cl. ..... 239/251; 239/252

[58] Field of Search ..... 239/251, 252, 256, 261, 239/225.1, 231, 525

[56] References Cited

U.S. PATENT DOCUMENTS

| | | | |
|---|---|---|---|
| 2,910,246 | 10/1959 | Hait | 239/252 |
| 4,193,548 | 3/1980 | Meyer | 239/252 X |
| 4,496,103 | 1/1985 | Pitchford | 239/252 X |

FOREIGN PATENT DOCUMENTS

| | | |
|---|---|---|
| 2237021 | 1/1974 | Fed. Rep. of Germany . |
| 3233274 | 3/1984 | Fed. Rep. of Germany . |
| 3419964 | 12/1985 | Fed. Rep. of Germany . |
| 1443742 | 7/1976 | United Kingdom . |

*Primary Examiner*—Andres Kashnikow
*Assistant Examiner*—Mary Beth O. Jones
*Attorney, Agent, or Firm*—Lowe, Price, LeBlanc, Becker & Shur

[57] ABSTRACT

The spray device comprises a central support and supply element bearing a rotational body for rotation about a central axis. At least one nozzle element is attached at the front surface of the rotational body at the outlet side of the spray device. The axis of the nozzle element is offset both to the central axis and to the direction of rotation of the rotational body. The rotational body is closely surrounded by a jacket.

21 Claims, 2 Drawing Sheets

SPRAY DEVICE

FIELD OF THE INVENTION

The invention relates to a spray device and more particular to a spray device including a rotatable nozzle.

BACKGROUND OF THE INVENTION

For cleaning automobiles or any type of machines a high-pressure pump supplies water to a spray device including a nozzle which produces a narrow sharp beam of water. Particularly effective is a spray device having a rotatable nozzle which directs a sharp beam to the surface to be cleaned. Due to an inclination between the axis of rotation and the direction the beam the point of impingement quickly moves in small circles. Known spray devices including a rotatable nozzle are of extremely complicated design, need a large number of parts and the sealing between the elements moving relative to each other is difficult.

Therefore, it is an object of the present invention to provide a spray device including a rotatable nozzle which device is extremely simple in design.

Another object of the present invention is to provide a spray device including a rotatable nozzle for which device there is no need for maintenance or service.

Still other object of the invention is to provide a spray device including a rotatable nozzle which device has an improved efficiency in cleaning.

SUMMARY OF THE INVENTION

These and other objects are achieved by a spray device including a rotatable nozzle, comprising a central support and supply element, a rotational body bearing on said element for rotation about a central axis, at least one nozzle element attached to the face side of the rotational body adjacent to an outlet side of said spray device the axis of said nozzle element being offset both in respect to the central axis and to the direction of rotation, and a jacket closely surrounding said rotational body.

Due to the specific angular offset of the nozzle element in respect of the rotational body a high rotational speed may be achieved without any considerable loss in pressure. This effect is enhanced by retarding elements acting under centrifugal force. Any leaking water is incorporated into the beam .

BRIEF DESCRIPTION OF THE DRAWINGS

FIG. 1 shows that the spray device including a rotatable nozzle according to the invention consists of only very few parts. In particular, FIG. 1 shows a central support and supply element 10 for connection to a well-known spray gun which via a valve is supplied with liquid preferably water at a high pressure from a high-pressure pump.

Figure 1:
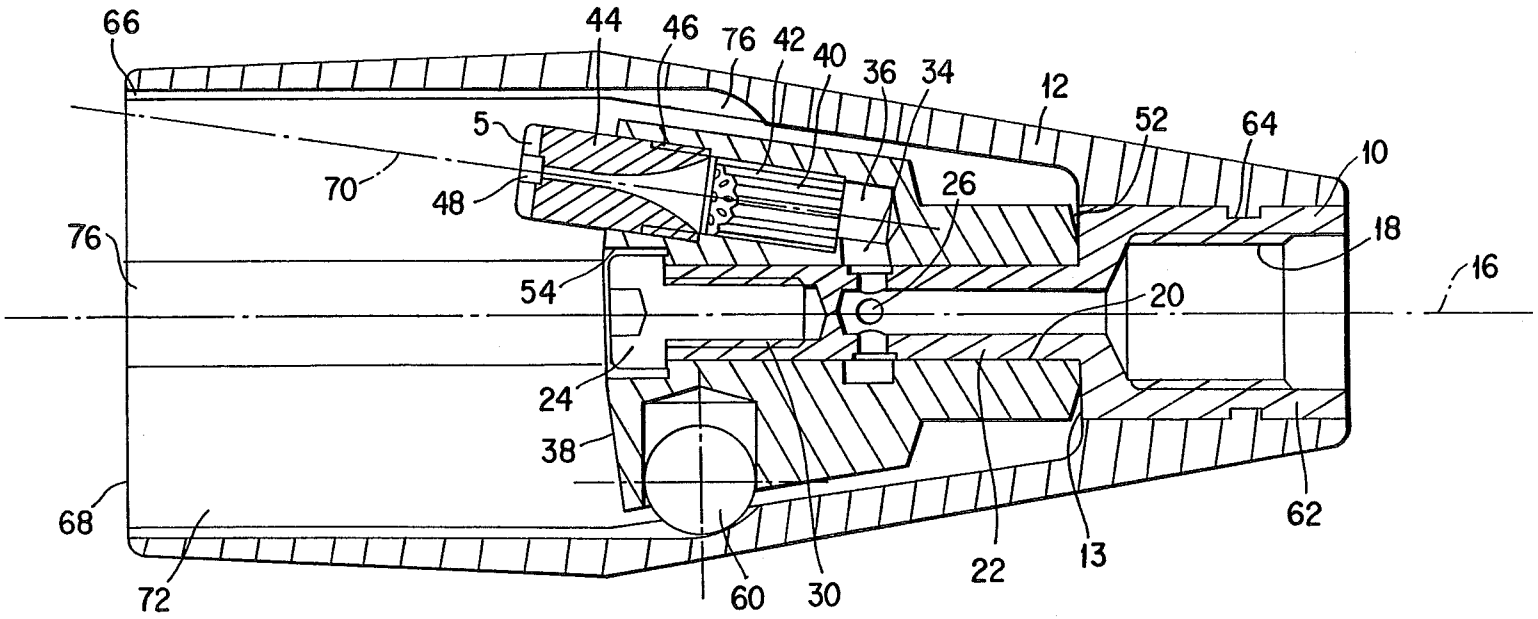
FIG. 1 is a longitudinal sectional view of an embodiment of the spray device according to the invention.
Figure 2:
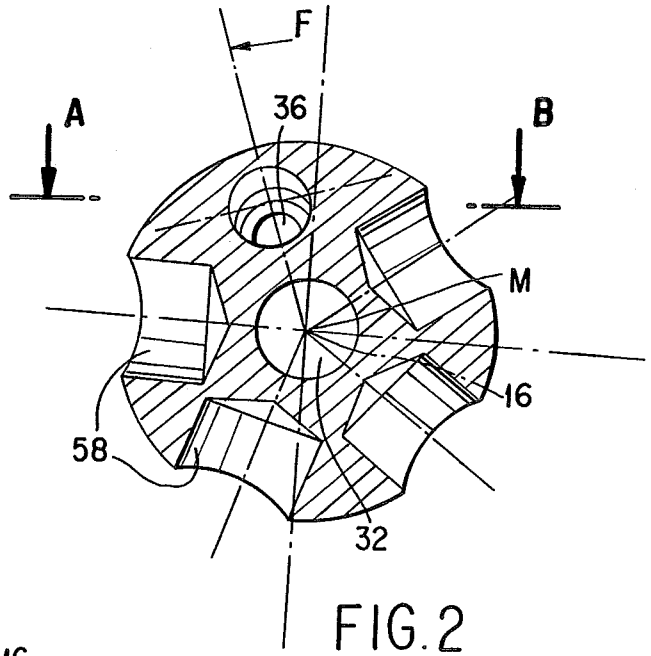
FIG. 2 is a sectional view through the rotational body used for the spray device according to FIG. 1 along the line D-E of FIG. 3.
Figure 4:
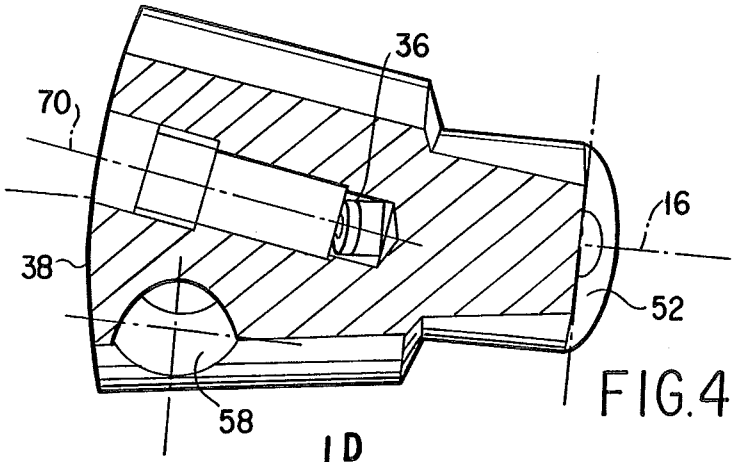
FIG. 4 is a sectional view of the rotational body along the line A-B-C in FIGS. 2 and 3.
Figure 3:
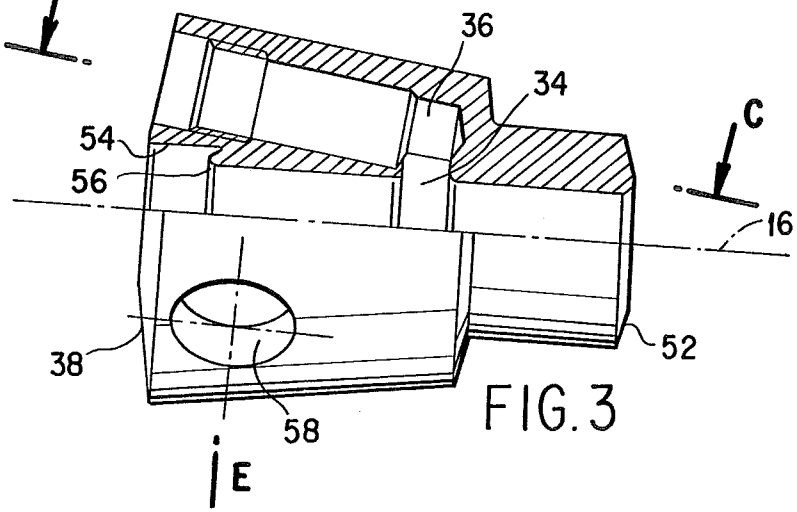
FIG. 3 is an elevational view of the rotational body of FIG. 2 partially in section along the line F-M in FIG. 2.

At the supply side of the support and supply element 10 there is attached a jacket 12 in the form of a chalice opening to the front side of the spray device.

The jacket 12 houses a rotational body 14 adapted to rotate about a central axis 16 of the spray device.

A threaded connection 18 at the supply side of the support and supply element 10 leads to a central bore 20 extending up to about the middle of a pinlike projection 22 of the support and supply element 10. The free end of the pinlike projection 22 is provided with a threaded bore into which a screw 24 may be screwed in, which limits a movement of the rotational body 14 in the direction of the axis 16.

Adjacent to the end of the bore 20 several radial bores 26 are distributed around the periphery of the pinlike projection 22. The bores 26 end in an annular recess 34 of the pinlike projection 22. The outer diameter of the pinlike projection 22 is in the region of the bore 20 slightly larger than in the region of the threaded bore 30.

The specific form of the rotational body 14 may be gathered from FIGS. 1 to 4. It is provided with a central bore 32 (FIG. 2) the diameter of which is adapted to the two outer diameters of the pinlike projection 22. In the region of the annular recess 28 the rotational body 14 is provided with a ring-like inner recess 34 which recess opens into an asymmetric bore 36 provided from the front face 38 of the rotational body 14. As may be seen from the figures the axis of the bore 36 is inclined at an acute angle in respect of the central axis 16 (FIG. 1). Furthermore, this bore 36 is offset in the direction of rotation as may particularly be seen in FIG. 4. The offsetting in respect of the direction of rotation may be at an angle of about 5° to 20°, preferably between 10° and 15°, and is effective to rotate the rotational body 14 in view of the pressure of the supplied water. The offset angle is of considerable influence on the rotational speed to be gained. Depending on that angle and the water pressure the speed may be in the order of several thousands of rotations per minute.

The acute angle (FIG. 1) between the central axis 16 and the axis of the bore 36 may be in the range of exemplary 5° to 20° and depends on the desired diameter of the beam generated by the spray device.

A uniforming body 42 is inserted into the bore 36 and comprises a plurality of parallel bores 40 distributed over the cross section of the body around the axis of the bore 36. The uniforming body is effective to streamline the curled water supplied from the radial bores 26 and the recess 34 and to guide the water into a nozzle 44 inserted at the front face 32 of the rotational body 14. The nozzle 44 preferably is threaded into the rotational body 14 and sealed therein by an O-ring 46. The nozzle 44 is provided with a tapered channel 50 leading to the exit of the nozzle 48 and having preferably a non-linear exemplary hyperbolical or parabolical tapering. At the exit the nozzle 44 may be provided with a slot 51 for inserting a screwdriver.

At the connection of the pinlike projection 22 the support and supply element 10 is provided with a radially extending flange 19 an annular region 52 of the rear face of the rotational body 14 being in opposition thereto. The peripheral region of the rear face is provided with a tapered phase. A central recess 54 at the front face 38 of the rotational body 14 houses the head of the screw 24. At the bottom of the recess 54 there is provided an annular flange 56 (FIG. 3) having essentially a circular contact to the bottom side of the head of the screw 24 (FIG. 1). It should be noted that the rotational body 14 has a certain clearance for movement in longitudinal direction on the pinlike projection 22.

In the region close the front face 38 the rotational body 14 is provided with radial openings in particular bores 58 peripherally distributed. Centrifugal elements, as balls 60 or rolls, may be inserted into the openings. The balls 60 are distributed over the periphery of the rotational body 14 such that in consideration of the asymmetric location of the nozzle 44 the rotational body is balanced in rotational symmetry.

FIG. 1 shows that the jacket 12 which may consists of synthetic material or metal is secured to a rear part 62 of the support and supply element 10 exemplary by pressing onto the rear part 62 provided with an annular recess 64. The jacket 12 surrounds the rotational body 14 in a relatively close distance the conical peripheral surface of the rotational body 14 being adapted to the conical inner surface of the middle part of the jacket 12. The jacket 12 projects over the front face of the rotational body 14 to such an extent that the concentrated beam of water ejected from the nozzle 44 just passes an inner rim 66 of a front opening 68 of the jacket 12 as it is illustrated in FIG. 1 by the dash-dot-line 70. Generally, the shape of the jacket 12 is preferably such that at least its inner surface broadens in diameter starting from the securing region whilst a front part 72 of the jacket is generally cylindrical. At least in the region of the balls 60 the interior of the jacket may be provided with recesses 76 which in the case of the embodiment according to FIG. 1 consist of longitudinal grooves which extend from the front edge 68 up to the balls 60 and are peripherally distributed.

It should be noted that in the interior of the total spray device no sealings are provided between elements moving relatively to each other.

The spray device including a rotatable nozzle operates as follows:

When supplying water through the central bore 20, the radial bores 26 to the recess 34 and through the uniforming body 40 to the nozzle 44 a torque is produced in view of the offset attachment of the nozzle 44 at the rotational body 14. The torque rotates the rotational body 14. The counter pressure caused in the nozzle 44 would urge the rotational body 14 in a direction to the right in FIG. 1 such that the annular surface 52 engages the flange 19. Due to the different hydraulic pressure surfaces in the annular recess 34 in respect of the front and rear parts of the rotational body 14 this pressure is at least partially compensated. Lubrication is not necessary since water penetrates between the interior surface of the rotational body 14 and the exterior surface of the pinlike projection 22 and between the two surfaces 19, 52. This leakage water is of no harm since it flows along the interior surface of the jacket 12 in a direction to the front edge 68 and is there taken along by the beam (not shown) from the nozzle 44.

For reducing the rotational speed at a high pressure at the outlet of the nozzle 44 preferably the balls 60 are provided which are urged radially outward by the centrifugal force produced during the rotation of the rotational body 14. These balls 60 are in frictional engagement to the interior surface 72 of the jacket 12 such that the rotational body 14 is retarded by frictional engagement. This retardation may be enforced by providing the grooves 76 into which the balls 60 temporarily enter during the rotation of the rotational body 14 which result in an increased braking.

In the foregoing a spray device including a rotatable nozzle has been described which may operate at a very high pressure and offers excellent cleaning capabilities. The device consists of very few parts, needs no sealings and no maintenance. Selecting the offset angle of the axis of the nozzle 44 in respect to the central axis and the direction of rotation and selecting appropriate diameters for the balls 60 and widths for the grooves 72 the spray device may be designed for quite different pressures. Otherwise disturbing leakage water is taken along by the sharp beam (not shown) of the nozzle 44. Due to the hydraulic pressure difference in the region of the recess 44 any friction at the face surfaces of the rotational body 14 is considerably reduced. The uniforming body 4 may be made of metal or synthetic material and the bores may be replaced by peripherally distributed longitudinal grooves.

It should be noted that the offset angle of the axis of the nozzle 44 is of influence on the starting characteristic of the spray device. Using an appropriate retarding means this offset angle should be selected such that the conical beam is not atomized by the air-resistance and centrifugal force.

What is claimed is:

1. A hand held spray device including a rotatable nozzle comprising:

a central support and supply element having an axial bore and radial openings extending outwardly therefrom through said element;

a rotational body supported on the central support and supply element for rotation about a central axis said body having a recess in communication with the axial bore through the radially extending openings in said control support and supply element;

at least one nozzle element attached to a face surface of the rotational body adjacent to the outlet-side of the spray device an inlet of said nozzle being disposed in communication with the recess in said rotational body;

an axis of the nozzle element being offset both to the central axis and to the direction of rotation of the rotational body; and a jacket carried by said device and disposed closely surrounding the rotational body.

2. The spray device of claim 1 wherein the rotational body is supported on the support and supply element without any sealings.

3. The spray device of claim 1, wherein the recess of the rotational body is provided with a uniforming body for streamlining the liquid in the direction of a beam ejected by the nozzle element.

4. The spray device of claim 1 wherein the nozzle element is provided with a channel tapered from an inlet to an outlet of the nozzle element.

5. The spray device of claim 1 wherein there are provided centrifugally acting retarding means on said rotational body.

6. The spray device of claim 5 wherein the retarding means comprise elements housed in radial openings in the rotational body the radial movement of the elements being confined by the interior surface of the jacket.

7. The spray device of claim 6 wherein the interior surface of the jacket is formed for providing an increased friction for the retarding elements during rotation of the rotational body.

8. The spray device of claim 7 wherein the interior surface of the jacket is provided with peripherally distributed longitudinal grooves.

9. The spray device of claim 1 wherein the jacket has the form of a chalice having a frustroconical region housing the rotational body and a tubelike region projecting beyond a front face of the rotational body.

10. The spray device of claim 1 wherein said at least one nozzle element is attached to the rotational body with such a direction that the beam ejected from the nozzle element closely passes an inner rim of a front edge of the jacket.

11. The spray device of claim 1 wherein the jacket is made of synthetic material pressed to an inlet end of the support and supply element.

12. The spray device of claim 1 wherein cylindrical regions are provided opposite the radial openings of the support and supply element and the diameters thereof together with the complementary inner diameters of the recess in the rotational body are dimensioned such that an hydraulic pressure difference is exerted onto the rotational body which counteracts the back pressure caused in the nozzle element during rotation of the rotational body and wherein the rotational body has predetermined clearance on the support and supply element in the direction of the central axis.

13. The spray device of claim 1 wherein the offset angles of the nozzle element in respect of the central axis of the spray device and in respect of the direction of rotation of the rotational body is in the range between 1° and 25°.

14. A hand held spray device including a rotatable nozzle comprising:

a central support and supply element;

a rotational body supported on the central support and supply element for rotation about a central axis;

at least one nozzle element attached to a face surface of the rotational body adjacent the outlet-side of the spray device;

an axis of the nozzle element being offset from both the central axis and the direction of rotation of the rotational body; and a jacket made of synthetic material pressed to an inlet end of the support and supply element and closely surrounding the rotational body.

15. The spray device of claim 14, wherein there are provided centrifugally acting retarding means.

16. The spray device of claim 15, wherein the retarding means comprise elements housed in radial openings in the rotational body the radial movement of the elements being confined by the interior surface of the jacket.

17. The spray device of claim 16, wherein the interior surface of the jacket is formed for providing an increased friction for the retarding elements during rotation of the rotational body.

18. The spray device of claim 17, wherein the interior surface of the jacket is provided with peripherally distributed longitudinal grooves.

19. The spray device of claim 14, wherein the jacket is in the form of a chalice having a frustroconical region housing the rotational body and a tubelike region projecting beyond a front face of the rotational body.

20. A spray device including a rotatable nozzle comprising:

a central support and supply element;

a rotational body supported on the central support and supply element for rotation about a central axis;

at least one nozzle element attached to a face surface of the rotational body adjacent to the outlet-side of the spray device;

an axis of the nozzle element being offset from both the central axis and the direction of rotation of the rotational body; and a jacket arranged coaxially to the rotational body and closely surrounding it and having a cylindrical front region projecting beyond a front face of the rotational body, the nozzle element being attached to the rotational body with such a direction that the beam ejected from the nozzle element closely passes an inner rim of a front edge of the jacket.

21. The spray device of claim 20, wherein there are provided centrifugally acting retarding means on said rotational body.

* * * * *